United States Patent [19]

Kosti

[11] 3,963,497

[45] June 15, 1976

[54] X-RAY FILM WITH HYDROPHILLIC LAYER CONTAINING DEVELOPING AND FIXING AGENTS

[76] Inventor: Carl M. Kosti, 704 Foxhall Road, Bloomfield Hills, Mich. 48013

[22] Filed: Jan. 6, 1975

[21] Appl. No.: 538,902

Related U.S. Application Data

[63] Continuation-in-part of Ser. No. 357,998, May 7, 1973, abandoned.

[52] U.S. Cl. ..... 96/76 R; 96/61 M
[51] Int. Cl.[2] ..... G03C 1/48; G03C 5/38
[58] Field of Search ..... 96/76 R, 61 M

[56] References Cited

UNITED STATES PATENTS

| | | | |
|---|---|---|---|
| 3,179,517 | 4/1965 | Tiegillus et al. | 96/76 R |
| 3,212,896 | 10/1965 | Yudelson et al. | 96/76 R |
| 3,260,598 | 7/1966 | Yutzy et al. | 96/76 R |
| 3,682,638 | 8/1972 | Kosti | 96/76 R |

*Primary Examiner*—David Klein
*Assistant Examiner*—Richard L. Schilling
*Attorney, Agent, or Firm*—Gifford, Chandler & Sheridan

[57] ABSTRACT

This invention relates to x-ray photography and more specifically to a film sensitive to x-rays wherein both developing and fixing chemicals are contained within a single hydrophilic layer of the film. The film, following exposure, can simply be placed in water for both development and fixing and without employing separate aqueous alkaline developers and aqueous acidic fixers.

10 Claims, 6 Drawing Figures

X-RAY FILM WITH HYDROPHILLIC LAYER CONTAINING DEVELOPING AND FIXING AGENTS

RELATIONSHIP TO OTHER APPLICATIONS

This application is a continuation-in-part of my prior application Ser. No. 357,998 filed May 7, 1973, now abandoned.

BACKGROUND OF THE INVENTION

The developing and fixing of an x-ray film, like most photographic film, usually involves the use of separate developing, fixing and rinsing baths. The preparation of such baths can be time consuming, can be somewhat of a nuisance, and can result in poor images because of, for example, too little or too much contact between the film and developing solution or between the film and fixing solution. More importantly, the practicing physician or dentist, while needing the developed film as quickly as possible, is forced to send the film out for processing or to maintain a developing studio in which he can carry out film developing — a task for which he is ill-prepared in terms of time and training.

In my U.S. Pat. No. 3,682,638 issued Aug. 8, 1972, I disclosed a radiosensitive film which comprises (a) a support, (b) an acidic gelatin-silver halide emulsion layer having a fixer dispersed therein and (c) an alkaline layer comprising a developer. The latter film can be developed and fixed by merely immersing it in running water at a temperature in the range of about 110°–125°F., for example. Although the latter film represents a significant advance in the art, continued improvement is desired in avoiding premature reaction between fixing agents and the unexposed silver halide.

Other workers in the art have also suggested ways of simplifying film development. For example, Tregillus et al, in U.S. Pat. No. 3,179,517 and Yutzy et al, in U.S. Pat. No. 3,260,598 suggest developing a film by contacting the exposed film with a web which contains the developer and fixer. Yudelson et al, in U.S. Pat. No. 3,212,896 suggest a film where a layer thereof includes both developers and fixers in heat sensitive capsules. In the latter case the exposed film is heated to release the active agents from the capsules.

It is an object of the present invention to provide a novel x-ray film which is simpler in structure than the films of the prior art, which is easier to develop, and which contains both developing and fixing agents in the same layer, and separate from the silver halides, in a manner such that the film is capable of producing a permanent negative by a novel one-step developing and fixing process and in a manner to avoid premature reaction between the fixing agents and the silver halides.

SUMMARY OF THE INVENTION

The invention deals with an x-ray sensitive film adapted to be developed in water and comprising (a) a support; (b) a silver halide containing emulsion layer on the support; and (c) an alkaline water soluble, hydrophilic layer containing both developing and fixing agents homogeneously distributed therethrough. In dental radiographic films, a thin lead foil is generally positioned on one side of the film. The hydrophilic layer is made alkaline in reaction, preferably about pH 10 – 12 when wetted, and contains the developing and fixing elements therein, and the emulsion layer is either neutral or acid, preferably acid, in reaction and contains the silver halide crystals suspended therein. The film of this invention differs from that described in my U.S. Pat. No. 3,682,638 in that, in the present film, both the developing and fixing agents are located in a single, common layer of the film.

The term "homogeneously distributed", as used herein, means the developing and fixing chemicals are dissolved in, or substantially evenly dispersed in, the alkaline hydrophilic layer itself and not isolated from contact therewith. This can be contrasted with the corresponding layer in said Yudelson patent wherein, although it might be said the capsules are homogeneously distributed, the developing and fixing chemicals are not, the latter being confined within the capsules, or "islands", out of contact with the remaining layer materials.

The term "water soluble", as used herein, means the water soluble layer dissolves, disperses, degrades, or the like, in water such that only the silver halide containing layer remains following water immersion. It is preferred that the water used is running water or that the film be moved relative to the water for more efficient development.

In the process of the invention, the film is exposed to a source of radiation to register a latent image. The exposed film is then preferably immersed in running water having a temperature in the range of about 50°F - 140°F., and preferably in the range of 75°– 100°F.; which, by virtue of the progressive dissolution of the hydrophilic layer, activates the developing and fixing elements therein. The latent image on the emulsion layer is thus developed in the usual manner well known to the workers in the art. During the period of development of the latent image the unexposed silver halides are not being acted upon. During the development period the fixing elements in the hydrophilic layer are chemically active but only slightly so because of the retarding effect of the alkaline substrate. The alkalinity of the hydrophilic layer thus accelerates the reduction of the silver halide to free silver while retarding the action of the fixing agent on the unexposed silver halides. However, as the alkaline hydrophilic layer becomes increasingly dispersed and as the rate of appearance of hydrogen ions in the acidic silver halide layer increases, the pH decreases and the predominant reaction shifts from one of development to one of fixing.

DESCRIPTION OF THE PREFERRED EMBODIMENT

Figure 1:
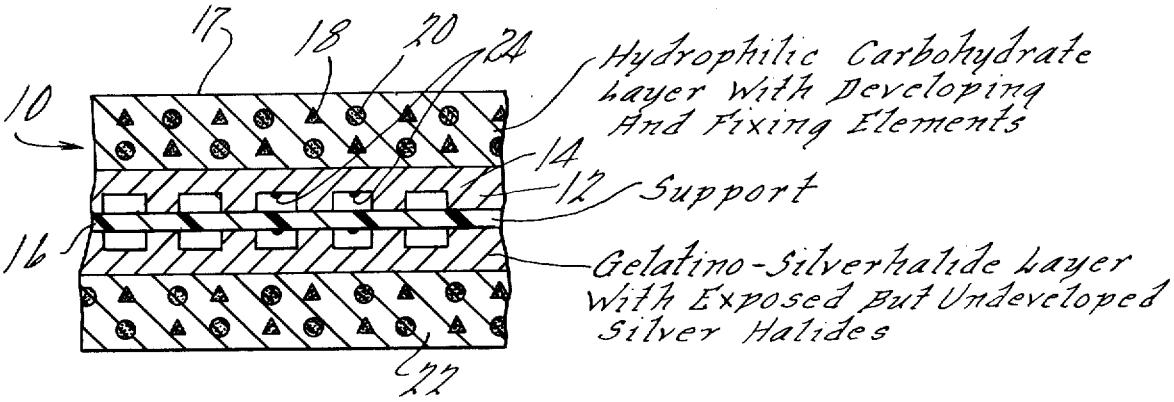
FIG. 1 is an enlarged fragmented cross-sectional view of the film of the invention showing, schematically from top to bottom, an alkaline hydrophilic layer containing the developing and fixing compounds, a gelatin-silver halide layer, a support, a second gelatin-silver halide layer, and a second alkaline hydrophilic layer; all at the time of exposure to X-radiation.
Figure 2:
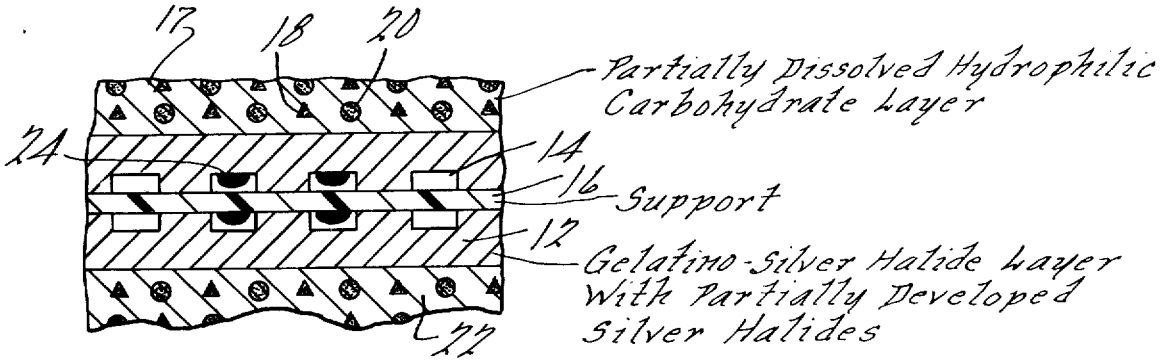
FIG. 2 is the same view following exposure to water and partial dissolution of the hydrophilic layer and illustrating the development stage.

In utilizing the film of the invention, and with particular reference to FIGS. 1–4; the film, indicated generally by reference numeral 10, is exposed to radiation to produce a latent image (FIG. 1) on the radiosensitive emulsion 12 comprising silver halide crystals 14 on a support 16. After exposure to radiant energy, the film 10 is placed under running tap water having a temperature in the range of about 50°– 140°F., thereby initiating the solution of developing chemicals and fixing chemicals as well as the alkaline material in the hydrophilic colloidal carbohydrate layers 17, 22. In the drawings the triangles 18 represent molecules or crystals of developing chemicals and the circles 20 represent molecules or crystals of fixing chemicals.

The developing elements 18 are of higher concentration and being in the alkaline environment of the hydrophilic layer 17 are more active than the fixing elements 20 which are retarded by the said alkalinity. The developing chemicals 18, together with hydroxyl ions (OH—), migrate toward the silver halide 14 and effect development of the image by the formation of free silver 24.

Figure 3:
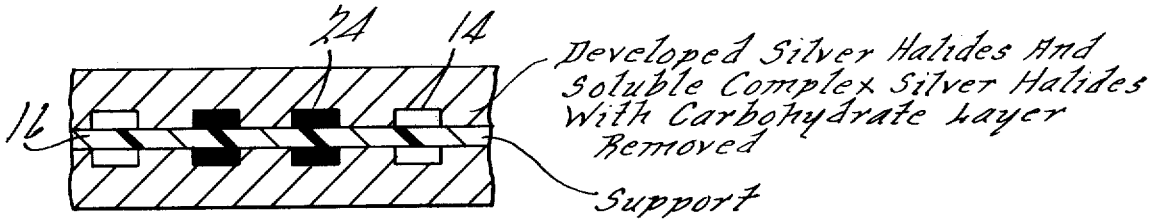
FIG. 3 is the same view following continued exposure to water with complete dissolution of the hydrophilic layer and illustrating the fixing stage.
Figure 4:
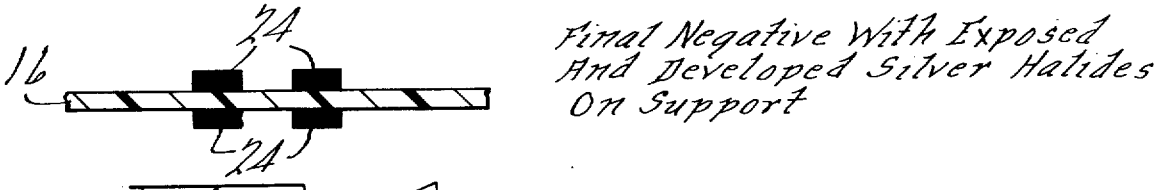
FIG. 4 is the same view following continued exposure to water and with the complete dissolution of gelatin and undeveloped silver halide.

As development continues the water (a) effects the removal of the hydrophilic layer 17 (FIG. 2) and, thus, the source of hydroxyl ions and (b), by penetration of the silver halide emulsion 14, initiates the solution of the acidic chemicals therein. The resulting drop in pH shifts the predominant reaction from one of development to one of fixing (FIG. 3). Solution of and removal of the unexposed silver halide 14, as well as dissolution of and removal of the emulsion surrounding the free silver 24, completes the process (FIG. 4).

The one step developing and fixing process, as described, requires generally less than about 2 minutes; depending on the temperature of the water, solubility of the hydrophilic layer, and other related factors; and results in a clean, dense, and well defined permanent radiograph.

The preferred materials for use as the hydrophilic layer which will contain both the developing elements and the fixing elements are polyvinyl alcohol and hydrophilic colloidal carbohydrates, particularly alginates and carboxylated cellulose. The advantage of the latter materials are their solubility in cold as well as warm water, their solubility in alkaline and acid solutions, their good film forming characteristics, their strong affinity for the developing and fixing grains within their miscelles preventing prior to development, migration of the same grains into the underlying layer, their minimal dimensional variations with respect to humidity changes, their excellent compressive strength, and their viscosity.

Other substances which can be used to form the hydrophilic layer are carbohydrates such as cellulose ether phthalate, methyl cellulose, ethyl cellulose and other cellulose derivatives; marine kelp products such as agar-agar; the water and alkali soluble dibasic acid esters of ethyl cellulose; alkali metal and amine salts of such dibasic acids as phthalic, maleic, and succinic; hydrophilic resins; and proteins, such as albumin and gelatin. Similarly, other film-forming materials which are hydrophilic and which do not react with the developer and fixer in the absence of water can be employed in place of the materials named. It is important that the developer and fixer be placed in a layer in which they can be chemically activated by diffusion of water through the layer.

A "hydrophilic layer", in the context of the invention, is a solidified layer (an emulsion, colloid, polymer, or the like) which is transparent to x-rays, which is permeable to water and which dissolves in or disintegrates in water to expose to the action of water the soluble materials contained therein.

The developer used in this invention may be any of the commercially available water soluble developers now known to the art. Examples of a suitable developer include 4-phenol catechol, N-beta hydroxy gentisamide, gentisamide, gentisaldoxime, 4-tertiary butyl catechol, 3-methoxy catechol, 4-hexylpyrogallol, 2-phenoxy hydroquinone, 4,4′-(2,3-dimethyl tetramethylene) dipyrocatechol, nordihydroquaiaretic acid, tolyl-duro-xylol, cumohydroquinones, 3,4-dihydroxy diphenyl, 2,5-dihydroxy diphenyl, 2,3 dihydroxy diphenyl, 6, 7, 8-tetrahydro naphtholhydroquinone, 1-phenyl-3-pyrazolidone, hydroquinone, di-aminophenol, paramethylaminophenol sulfate and like reducing agents. The preferred developer for use in the film of this invention is hydroquinone, generally in a weight ratio of about 1:16 to 1:50.

Alkaline materials are used to adjust the alkalinity of the hydrophilic colloidal carboyhydrate layer to a pH in the range of about 8 to 14. Examples of such materials are sodium carbonate, sodium hydroxide, potassium carbonate, potassium hydroxide, sodium borate, and combinations thereof.

The gelatin-silver halide emulsions employed in the x-ray sensitive layer processed in accordance with this invention are the usual emulsions used in the photographic arts and have a pH in the range of about between 2 and 7, but preferably below 6, and can be gelatin-silver chloride, gelatin-silver chlorobromide, gelatin-silver chloroiodide, gelatin-silver chlorobromoiodide, gelatin-silver bromide, and gelatin-silver bromoiodide emulsions of the developing out type. Such emulsions can be prepared by well known methods as taught in such patents as U.S. Pat. No. 2,618,556. The speed and the average gradient of the film emulsion is determined by the applicable method contained in the American National Standard Method for Sensometry of Medical X-Ray Films pH 2.9 – 1964. The speed of the emulsion shall be as indicated in 1.2.1 and the average gradient shall be not less than about 1.5.

The support 16 of the film of the invention can be any of the common supports used for photographic and radiographic products including cellulose nitrate film, cellulose acetate, cellulose triacetate, cellulose acetate-butyrate, polyvinyl acetate, polystyrene, polystyrene terephthalate, bisphenol-A polycarbonate and related films of resinous materials as well as glass plates, paper base, metals and others. The support preferably should be of some safety type as defined by American National Standard Specifications for Safety Photographic Film pH 1.21 – 1965. The thickness of the support is generally not less than about 0.10 mm (0.004 inch) nor more than about 0.23 mm (0.008 inch).

A lead foil or other equally flexible material with equivalent x-ray attenuation characteristics as measured at 90 kilovolt peak, generally not less than 0.060 mm (0.0024 inch) thick, is positioned so as to be on the side away from the x-ray tube.

Fixing agents in accordance with this invention are the usual chemicals used in the art such as the metallic salts of thiosulfates and thiocyanates; for example, potassium thiocyanate, sodium thiocyanate, ammonium thiocyanate and mixtures thereof.

Plasticizers such as stearic acid, glycerol, glycols and other related compounds with plasticizing characteristics may be added to impart sufficient plasticity to the hydrophilic layer and to retain dimensional stability.

In the preferred form of the invention the hydrophilic layer containing both developing and fixing agents is coated on both sides of the film support, each such layer being placed directly on top of a gelatin-silver halide layer. However, one gelatin-silver halide layer and one hydrophilic layer is satisfactory. It is not a requirement that the hydrophilic carbohydrate layer be superimposed on the silver halide coating layer. Thus, the silver halide coating layer can be on one side of the film support while the hydrophilic carbohydrate layer is on the opposite side. In this latter embodiment however, it is preferred to develop the exposed flm in still water.

The gelatin-silver halide emulsion may be modified by the incorporation of optic sensitizers such as green sensitizer, cyanine or mercuro-cyanine sensitizers , or chemical sensitizers such as sulfur, gold, etc. or other common emulsion addenda.

The following example will serve to explain and better illustrate the invention.

EXAMPLE

A radiographic element according to the invention was prepared as follows:

A cellulose acetate film, 0.008 inch thick, was coated on both sides with 10 cc. per square foot of a gelatin-silver chloride emulsion. The emulsion composition was as follows:

| | |
|---|---|
| Gelatin-silver chloride emulsion (containing one mole of silver per 3500 grams of emulsion) | 280 grams |
| 15% saponin solution | 40 cc |
| Water | 120 cc |

Superimposed on top of each of the light sensitive emulsion layers was a hydrophilic colloidal carboxylated cellulose layer containing developing elements, fixing elements, antifoggants, saponin solution, water, and other hardening and plasticizing additives. The composition of the carboxylated cellulose layer was as follows:

| | |
|---|---|
| Hydrophilic carboxylated cellulose | 12 grams |
| Developer solution | 90 cc |
| Fixer solution | 30 cc |
| Water | 80 cc |

The developer solution had a pH of about 9.0 and contained the folowing materials:

| | |
|---|---|
| Sodium sulfite, anhydrous | 50 grams |
| Sodium carbonate, anhydrous | 60 grams |
| Hydroquinone | 12 grams |
| 1-Phenyl-3-pyrazolidone | 0.5 grams |
| Potassium bromide | 2 grams |
| Restrainer solution | 20 cc |
| Water to make | 1,000 cc |

50 g. of anyhdrous sodium sulfite was dissolved in 750 cc of water at about 50°C. 60 g. of sodium carbonate was then added to the warm water and stirred until complete dissolved. The developing agents hydroquinone and 1-phenyl-3-pyrazolidone, 12 g. and 0.5 g. respectively, were slowly dissolved in the solution followed by 2 g. of potassium bromide and 20 cc of restrainer solution. Added to this solution was a sufficient amount of cold water to bring the total volume to 1,000 cc.

| The fixing solution contained the following materials: | |
|---|---|
| Sodium thiosulfate | 320 grams |
| Sodium sulfite, anhydrous | 30 grams |
| Boric acid | 10 grams |
| Acetic acid, glacial | 18 grams |
| Potassium alum | 25 grams |
| Water to make | 1,000 cc. |

320 g. of sodium thiosulfate was dissolved in 500 cc of 50°C. water and, when the solution cooled, 30 g. of sodium sulfite was dissolved therein. 10 g. of boric acid, 18 cc of glacial acetic acid and 25 g. of potassium alum were dissolved in 150 cc of 50°C. water and allowed to cool to below 21°C. When cooled to the desired temperature, the latter solution was slowly poured into the sulfite-hypo solution. Finally, cold water was added to make up the total volume of 1,000 cc.

12 g. of hydrophilic carboxylated cellulose was slowly added to 80 cc of room temperature water with constant stirring until a viscous emulsion was obtained. To this emulsion, 90 cc of developing solution and 30 cc of fixing solution were added slowly to form a smooth, homogeneous viscous liquid. The emulsion, upon setting, was coated on each of the gelatin-silver chloride layers at a concentration of 15 cc per square foot.

The concentration of the developing agent in the emulsion is dependent in part on the density of the negative desired but can be of the order of less than 350 g. per kilogram of silver nitrate, converted to silver chloride, used in making of the emulsion, to obtain good clearance, and to obtain an emulsion having optimum keeping property.

The function of the restrainer in the developing solution is to prevent unduly rapid breakdown of the protective layer surrounding each silver halide grain, and by this means to reduce as far as possible the chance of unexposed grains developing in the normal developing time. This effect is particularly desired in the concept of my invention where developing and fixing is a one-step process. Two main types of restrainers (antifoggants) are used, inorganic and organic. The principal inorganic restrainers are bromide salts, such as potassium, sodium, ammonium, magnesium and other bromides; potassium bromide being the most common. Of the organic restrainers, benzotriazole has been found to be most effective. In this role the restrainer benzotriazole acts to (1) minimize the risk of fog and staining on materials subjected to prolonged development at high temperatures, and (2) help to prevent fog or veiling on materials which have been stored under unfavorable conditions or which are of doubtful age.

The radiographic element prepared as described above was exposed to an ionizing radiation at 60 kilovolts and 15 milliamperes for 0.2 seconds. The resultant exposed element was placed under running tap water having a temperature of about 50°C. for about 2 minutes and produced an excellent radiograph. During development approximately 85% of the exposed silver chloride crystals are reduced in the first 20 to 30 seconds. The fixing elements are much slower to react due to the initial alkalinity of the substrate and the higher activity of the developing elements. During the initial 20 to 30 seconds of development the number of unexposed silver chloride crystals reacted with by the fixing elements is minimal. At this time a density reading of Gamma about 1.35 is reached and the developing curve begins to level off due to partial neutralization of alkaline materials from the carbohydrate layer by the appearance of hydrogen ions in the gelatin-silver chloride layer. The rate at which events occur depends on (1) the precalculated amount of developing elements used to effect a desired Gamma value; (2) the rate of exhaustion of the developing elements as the carbohydrate layer is dissolved and removed by the water; and (3) the rate of neutralization of alkaline materials of the carbohydrate layer by the hydrogen ions from the gelatin-silver halide layer.

Figure 5:
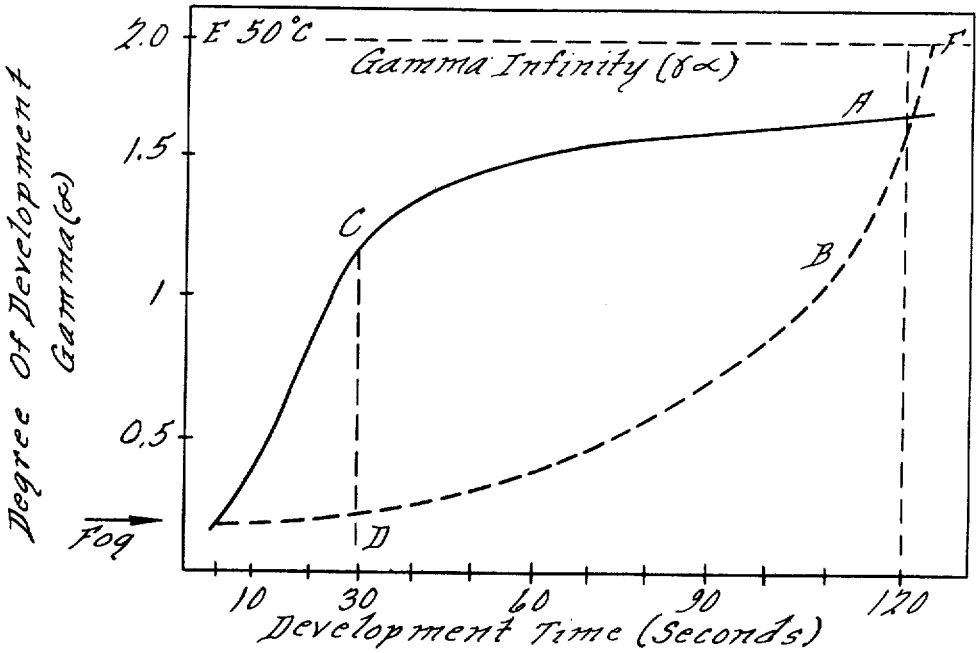
FIG. 5 is a graph of the developing process and fixing process wherein gamma (the degree of development) is the ordinate and development time is the abscissa.

This effect is shown graphically in FIG. 5 where curve A indicates the developing Gamma value in relation to time and broken line curve B indicates the fixing value in relation to time. The developing curve A shows the rapid rise of Gamma up to a value of 1.35 whence it increases at a much slower rate until, finally, the desired Gamma is reached. The broken vertical line C – D indicates the increment between degree of development and degree of fixing of the negative. The horizontal line E – F signifies the Gamma infinity which is never reached in the concept of this invention. Gamma infinity is not desirable since prolonged development is accompanied by an increase in fog and graininess, either or both of which may reach an objectionable level. It is also undesirable to employ the very bottom part of the curve, where a small increase in development time gives a big increase in Gamma, because in this region any slight inequalities in the degree of development across the film will be accentuated, with the likelihood of uneven density, or mottle. The broken line curve B represents the fixing period of the invention where the start of the reaction is very slow and then builds up more quickly as the acid gelatin-silver halide emulsion layer is approached. The developing elements do not affect the unexposed silver halides in the time allowed for the developing stage, in this case about 20 to 30 seconds; however, if the development is allowed to proceed then some of the silver halide unexposed to radiation may become affected, resulting in fog formation. Conversely, the fixing elements in the carboyhydrate layer have a very slow start and do not interfere with the action of the developing elements at the beginning of the developing process. Ultimately, when the pH has reached a sufficiently low point the fixing elements effect the removal of silver halides.

Figure 6:
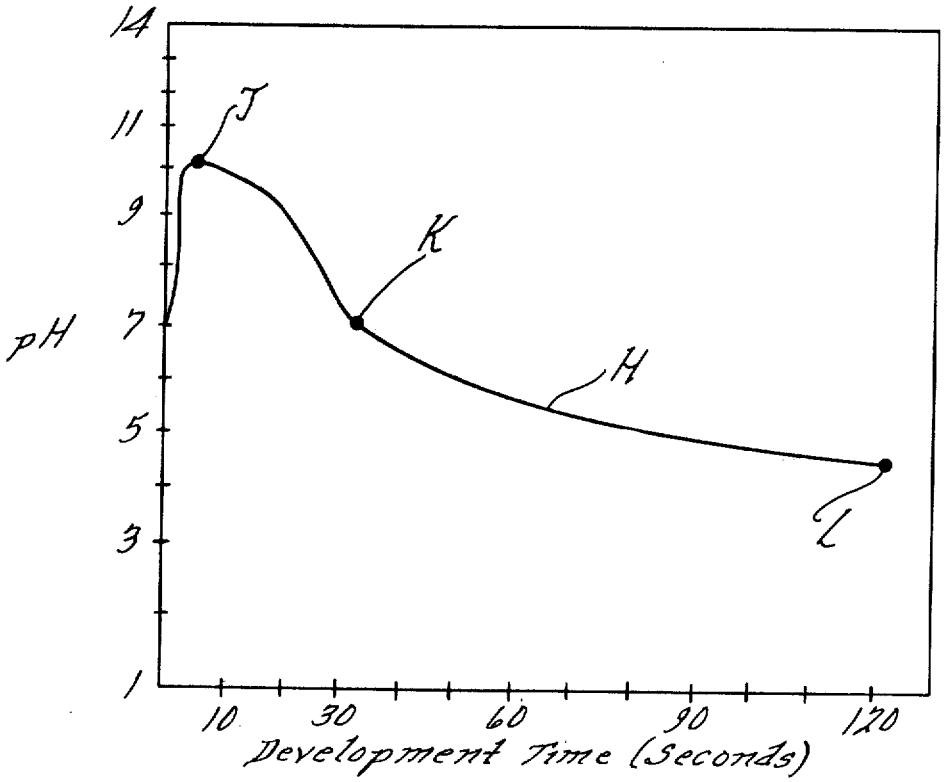
FIG. 6 is a graph of pH variations during the developing and fixing stages of the invention.

The chemical reactions of the above processing can be appreciated more easily by reference to FIG. 6 wherein solid curve H approximates schematically the changes in pH in the halide emulsion during the development and fixing stage under the conditions of the foregoing Example. It becomes apparent that an important feature of the invention is the gradual drop of the pH from alkaline to acid values. As water contacts the alkaline materials in the hydrophilic layer, the pH approaches its highest value at point J. About 85% of the silver halide exposed to radiation is reduced to silver in about 20 to 30 seconds. At this point the water in the carbohydrate layer does not significantly affect the fixing elements since they are very sparingly soluble in alkaline solution. However, as the time of the development increases the pH value decreases to about 7 in about 30 seconds. With further gradual decrease of pH from 7 at point K to 4.5 at point L the activity of the fixing elements is increased so that the greatest amount of dissolution of the unexposed and undeveloped silver halides occurs approximately during the last 20 to 30 seconds of the process.

The Gamma value may be controlled by the following factors; (1) varying the log exposure — the density grows as the exposure increases, (2) altering the concentration of the developer, (3) increasing or decreasing the time of development, (4) changing the composition of the silver halide emulsion, and (5) varying the temperature of the solution. In the concept of my invention the Gamma value; that is, the measure of density or degree of development; is predetermined and the slope of the Gamma curve is a constant if the temperature is constant, since all other factors, vis., the composition of the emulsion, the exposure, the concentration of the developer, and time of the development related to the solubility of the hydrophilic layer, are absolutely controlled. Therefore, the example given here does not limit the invention to 2 minutes developing. Rather, it is apparent that by controlling one or more of the factors listed above the duration of developing can be altered.

The hydrophilic layer may be dyed with appropriate artificial and food dyes to protect the radiosensitive film from being exposed in natural and artificial light during the developing process. The film prepared in accordance with this invention may be completely developed in natural or artifical light without danger of exposure. This method completely eliminates the darkroom technique of development as is heretofore the common practice.

For purposes of increased shelf life, the entire radiographic element as described above can be treated with water-resistant materials such as polyethylene glycols and other glycol derivatives; synthetic resins for example of the coumerone-indene resin type; paper, plastics and other similar products which resist the penetration of moisture from the air but which are removable by immersion directly in water.

The most significant point of the invention is the onestep processing of a radiosensitive film made possible by incorporation of the developing elements and fixing elements in one hydrophilic layer where upon placement of the exposed film in water the rate of development is determined solely by the temperature of the water. Further, it is important that the developing and fixing elements can be preserved in one substrate for a long period of time without chemical interference with each other or with the silver halide. The present invention makes possible the preservation of the processing substances for a long period of time in an inactive state and activation can be initiated only by dissolution in water of the hydrophilic material around the developing and fixing agents.

While this invention has been described in detail with particular reference to preferred embodiments thereof, it will be understood that variations can be effected within the spirit and scope of the invention.

I claim:

1. In a film which comprises an x-ray sensitive, acidic or neutral, silver halide containing emulsion layer on a support the improvement which comprises:

an integral alkaline, hydrophilic, water soluble layer in said film, said hydrophilic layer including both developing and fixing agents homogeneously distributed therethrough.

2. The film according to claim 1 wherein there are two said emulsion layers, one on each side of said support, and there are two said hydrophilic layers, one on each of said emulsion layers.

3. The film according to claim 1 wherein said hydrophilic layer is a solidified emulsion comprising a member of the group consisting of carboxylated cellulose; cellulose ether phthalate; methyl cellulose; ethyl cellulose; alginates; agar-agar; polyvinyl alcohol; water and alkali soluble dibasic acid esters of ethyl cellulose; the alkali metal and amine salts of phthalic, maleic, and succinic acids; hydrophilic resins, gelatin; and albumin.

4. The film according to claim 1 wherein said hydrophilic layer comprises a colloidal carbohydrate.

5. The film according to claim 4 wherein said carbohydrate is carboxylated cellulose.

6. The film according to claim 1 wherein said hydrophilic layer comprises an alginate.

7. The film according to claim 1 wherein said hydrophilic layer comprises polyvinyl alcohol.

8. The film according to claim 1 wherein said hydrophilic layer has a pH of about 10 – 12 and said emulsion has a pH below about 7.

9. The film according to claim 1 wherein a lead foil covers one side of said film.

10. The film according to claim 1 wherein said hydrophilic layer comprises a colloidal carbohydrate and has a pH of about 10 – 12 when wetted.

* * * * *